US005555953A

United States Patent [19]

Henderson

[11] Patent Number: 5,555,953

[45] Date of Patent: Sep. 17, 1996

[54] PORTABLE SCAFFOLDING ATTACHMENT FOR FRONT END LOADER OR FORKLIFT

[76] Inventor: Gary R. Henderson, 19353 Windward Cove, Gulfport, Miss. 39503

[21] Appl. No.: 368,010

[22] Filed: Jan. 3, 1995

[51] Int. Cl.[6] ..... E04G 1/00; B66F 11/00

[52] U.S. Cl. ..... 182/141; 182/118; 182/148; 182/63

[58] Field of Search ..... 182/141, 148, 182/115, 159, 160, 156, 2, 63, 21, 118; 108/901

[56] References Cited

U.S. PATENT DOCUMENTS

| | | | |
|---|---|---|---|
| 679,003 | 7/1901 | McRay | 182/118 X |
| 1,115,803 | 11/1914 | Gallagher | 182/156 X |
| 1,166,141 | 12/1915 | Merrettig | 182/156 X |
| 2,362,170 | 11/1944 | Swaisgood | 182/2 X |
| 2,672,377 | 3/1954 | Werner et al. | 182/2 |
| 3,191,717 | 6/1965 | Hiyama | 182/63 X |
| 3,415,339 | 12/1968 | Range | 182/2 |
| 3,493,079 | 2/1970 | Dudschus | 182/63 X |
| 3,807,575 | 4/1974 | Merrick | 182/2 |
| 4,004,652 | 1/1977 | Laboy-Alvarado | 182/152 X |
| 5,381,872 | 1/1995 | Peruzzi et al. | 182/63 |
| 5,497,851 | 3/1996 | Walcher et al. | 182/148 X |

FOREIGN PATENT DOCUMENTS

| | | | |
|---|---|---|---|
| 5294600 | 11/1993 | Japan | 182/141 |

*Primary Examiner*—Karen J. Chotkowski

[57] ABSTRACT

A scaffolding system which is attached to a prime mover such as a front end loader or forklift and has "Wings" or platforms extending outward from a "Center Frame" or platform and rotating in relation to it. The surface of the "Wings" upon which workmen stand is made up of individual steps. The tread of each step remains in a horizontal position during "Wing" rotation by using the principle of parallel arms. The "Center Frame" or platform can rotate in relation to a "Base Frame" to level the working surface despite the prime mover sitting on a sloping surface. All working surfaces are equipped with necessary guard rails. Hydraulic controls and emergency shut down switches are located for safe operation by all workmen.

1 Claim, 4 Drawing Sheets

PORTABLE SCAFFOLDING ATTACHMENT FOR FRONT END LOADER OR FORKLIFT

BACKGROUND

1. Field of Invention

The presented invention relates to a surface element upon which workmen are supported. In particular it is a support surface attached to a prime mover such as a front end loader or forklift and has one or more movable wings or platforms to extend the work area and adjust it to the vertical contour of the work.

2. Related Art

Throughout the construction and facility maintenance industry there exists a requirement to provide workers with a safe platform on which to work above ground level. To date this requirement has been met in a variety of ways from very simple built-in-place wood and steel scaffolding to self propelled lifting devices. While many methods of providing elevated work platforms exist, falls from scaffolding continue to be one of the major safety problems in the construction industry. To be effective the scaffolding system must provide a stable platform upon which workers may move about; its height should be adjustable to the work being performed since continued bending and stretching can lead to injuries and reduce productivity; it should be relocatable quickly and safely; and be economically practical as compared to other systems.

Three major types of scaffolding are known to be in use in the construction industry. Scaffolding framework made of steel or aluminum tubing assembled on the job site with timber or manufactured walkways is one widely used system. It is labor intensive to relocate, relies on uniform support of the surface where erected and generally provides a working surface in 2 foot increments of elevation. The walkway portion of the system is manually moved up or down as the work progresses exposing the workers to increased danger of falling during the process. The invention presented here could be moved in a matter of minutes to another location by one person and adjusted to the exact height and slope of the work.

A second method widely used in residential and light commercial construction are manually operated jacking systems. These generally use wood, steel or aluminium vertical members set on the surface of the work site and secured at their top to the structure being worked on. A jacking mechanism is attached to vertical members and planking is laid between each jack. This system requires considerable labor and exposes personnel to high risk of falling while attaching the upper support of the system to the building. Many times it is used without proper walkways and handrails. With the invention presented here the walk way and handrails would be an integral part of the machine insuring safety procedures are more easily followed.

A third method widely used is the self propelled and/or power lifting scaffolding systems. Some use hydraulic actuated arms to lift a working platform into position, or some type of scissor arm arrangement to lift and lower the work platform. While these systems allow the mobility similar to that of the invention presented here they differ in several ways. They use an internal system of power for movement and lifting, they do not provide the long span foldable work platform provided by this invention, and the work platform is not designed to be configured into a stairway type support system.

While a wide variety of attachments are available for use on front end loaders and forklifts a scaffolding system utilizing movable arms and self-leveling steps is not produced. Many times "jury rigged" platforms are used on forklifts or front-end loaders. To date those known to the inventor include only simple box like platforms with no moving parts.

SUMMARY OF INVENTION

The invention is a scaffolding system attachment to be used with from-end loaders found on utility and agriculture tractors, backhoes, and earthmoving machines or on forklifts and fork trucks. Hereafter, any type of front-end loader or forklift will be referred to as the prime mover. As seen in FIG. 1 the invention is made up of four major components. The "Base Frame" which would be mounted to the prime mover as required by the various manufactures of prime movers. Attached to the "Base Frame" would be the "Center Frame". Attached to each side of this "Center Frame" are two hydraulically rotatable work surfaces or "Wings". The working surface or platform of each "wing" is made up of individual steps. Each step rotates in relation to the "Wing's" rotation by using the principle of parallel arms. This rotation is such that the tread of each step always remains in a horizontal position. Both the "Center Frame" and "Wings" can be fitted with guard rails to prevent fails. As seen in FIG. 2 the invention depends on the prime mover to lift the invention to the desired elevation and rotate the working surface into a level position in relation to the fore and aft line of the prime mover using its curling motion. As seen in FIG. 3 the "Center Frame" 5 rotates in relation to the "Base Frame" 1, about pin 2, as hydraulic cylinder 4 is extended or retracted. This allows the invention to be leveled despite the prime mover sitting on a side slope as shown. The outboard end of each "Wing" can be rotated from a fully upright / vertical position, as seen in FIG. 3, down to approximately 45 degrees below the horizontal plane of the "Center Frame" as the right "Wing" in FIG. 1 is positioned. Using hydraulic power from the prime mover the hydraulic controls for the invention can be location within easy reach of a worker standing on the "Center Frame", as shown in FIG. 1, and/or located for use by the operator of the prime mover. The hydraulic controls for the lifting, lowering, and curling functions of the prime mover can, if necessary, be duplicated within easy reach of a worker standing on the "Center Frame" as could an electrically operated emergency "kill switch" for the prime mover. The dimensions of the invention's components could vary considerably based on the size of the prime mover with which it is to be used. It could be constructed of a variety of materials with steel and aluminum alloys being the most likely. The advantages of this system as compared to other scaffolding systems include: (1) Easily relocatable about a work site by one person. (2) Easily adjustable to the most ergonomically correct height for a safer more productive work platform. (3) Rotating "Wing" follows the vertical contour of the work. (4) Self leveling steps provide a safer working surface than an angled surface. (5) Used as a portable stair it would be much safer than ladders generally used as temporary access to high areas such as roofs. (6) Increases capabilities at a low cost, because the prime mover can be used for other tasks thus increasing its usage and lowering its per hour cost.

DETAILED DESCRIPTION

Figure 1:
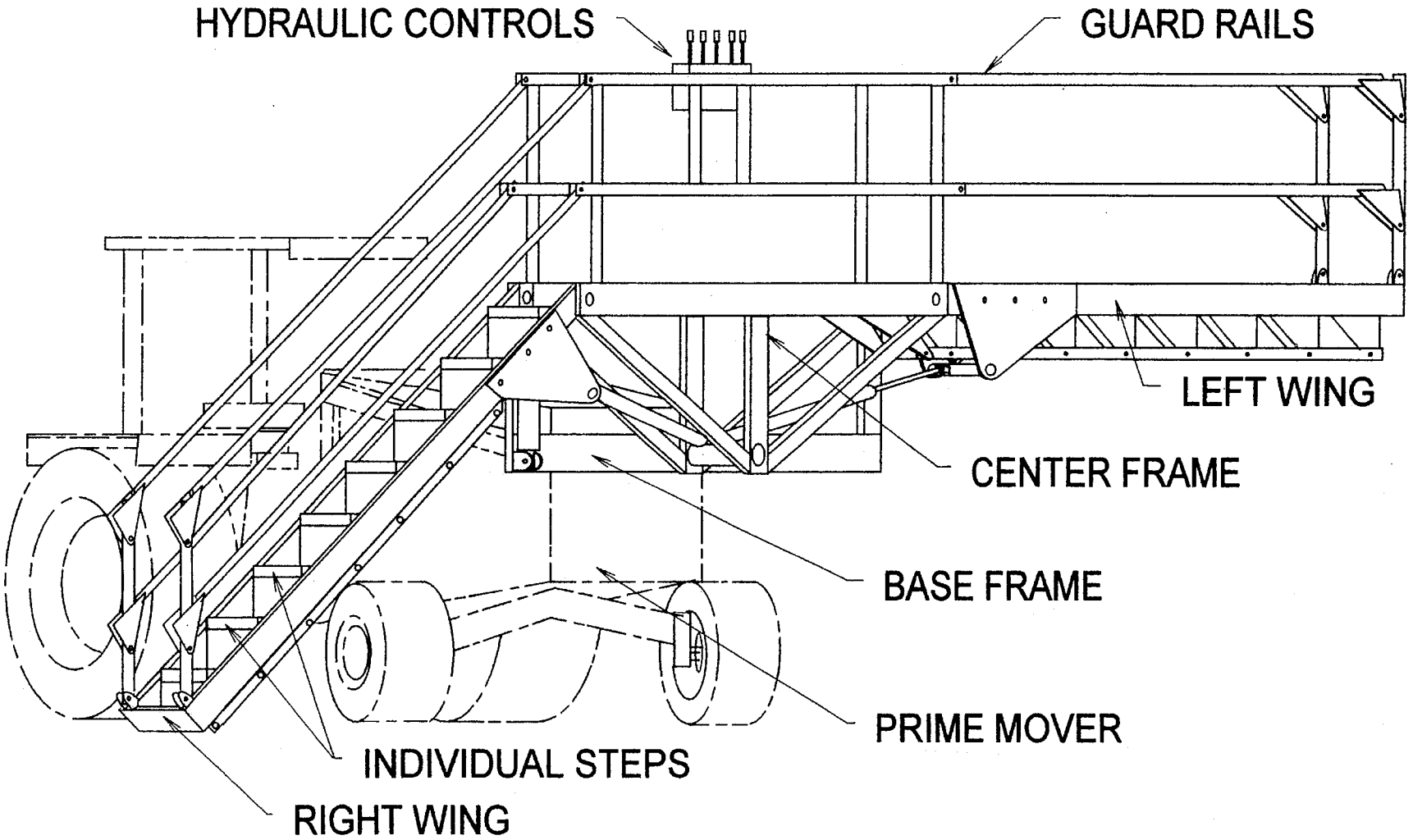
FIG. 1 is a perspective view of the invention mounted on an utility tractor with front end loader. The right "Wing" is in the down position and the left "Wing" in the horizontal position.
Figure 2:
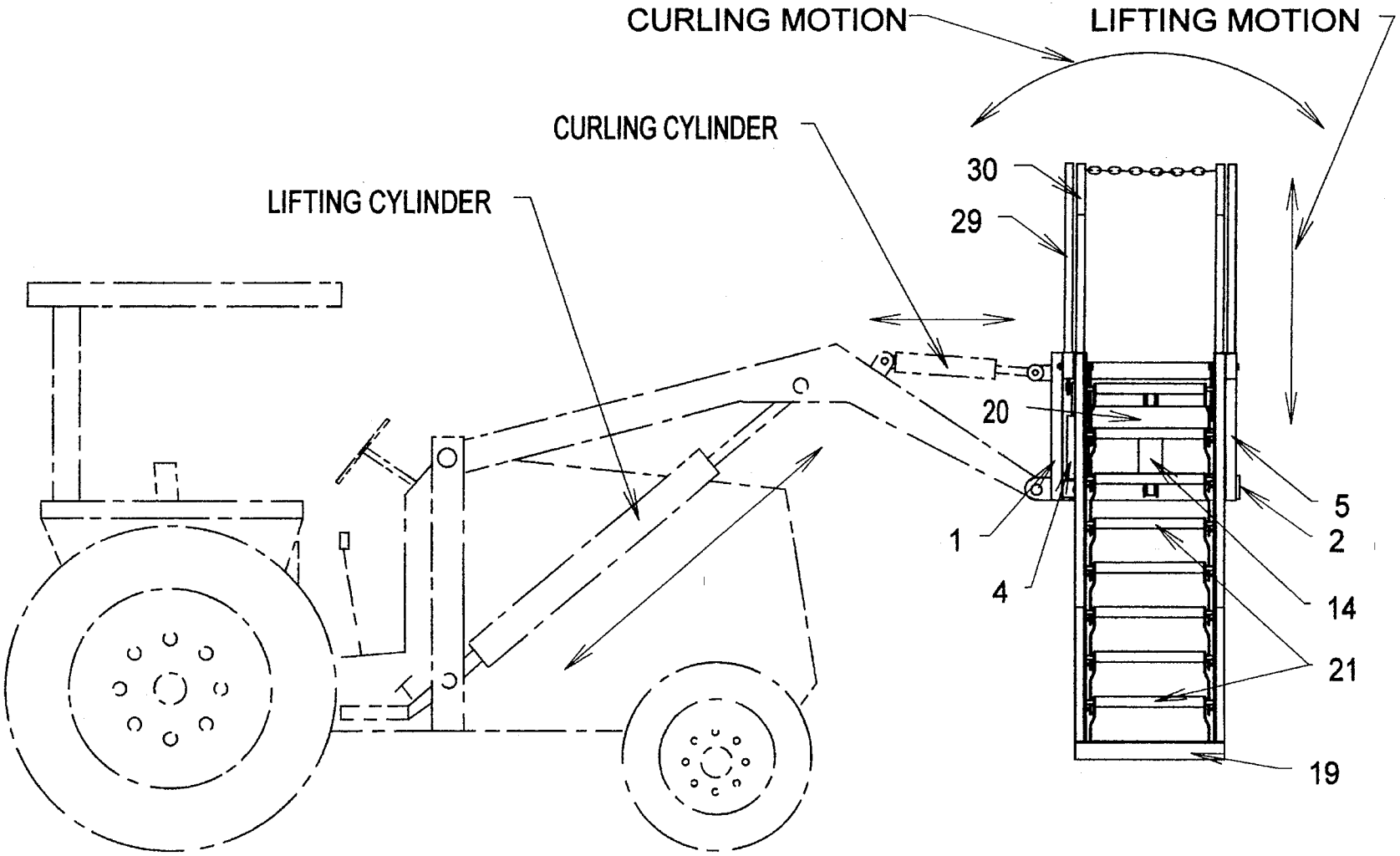
FIG. 2 is a side view with the invention mounted on an utility tractor with front end loader. The right "Wing" is in the down position and the lifting and leveling motion required of the prime mover are indicated.
Figures 4, 4A:
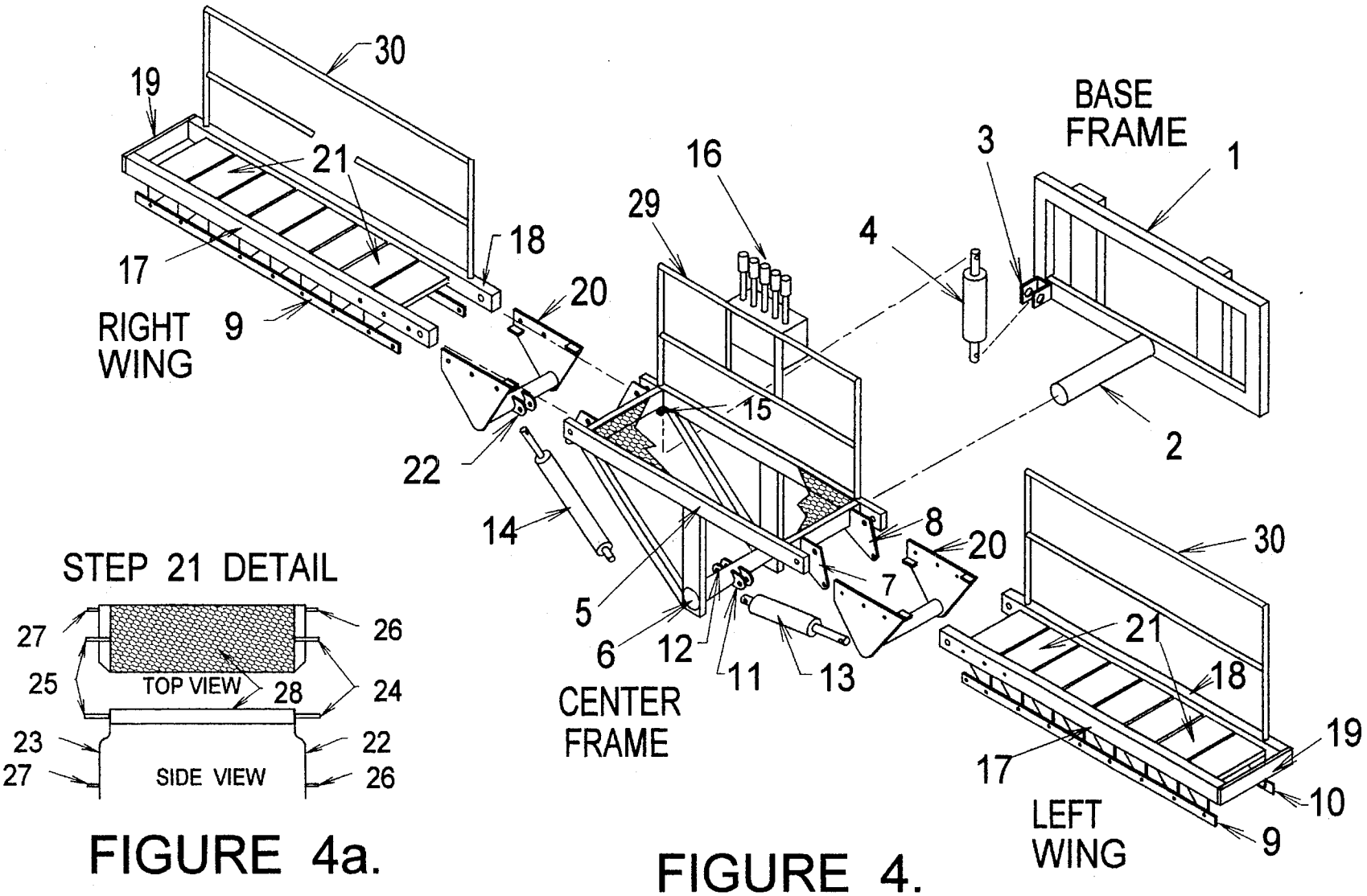
FIG. 4 is an exploded view of the invention showing all major components
FIG. 4*a* is a top and side view of the individual steps which make up the "Wing's" working surface.

The invention consists of four major assemblies as shown in FIG. 1. These are the "Base Frame"; "Center Frame"; "Left Wing" and "Right Wing". The "Base Frame" as seen in FIG. 4 consists of a ridged frame 1, the "Center Frame" support pin 2, hydraulic cylinder attachment bracket 3 and hydraulic cylinder 4. Attached to the back side of frame 1 (and not shown) would be various coupling devices for attaching frame 1 to the prime mover. These coupling devices would vary with the type of prime mover the invention was to be attached to and are not considered part of this invention.

As seen in FIG. 4 the "Center Frame" is made up of a rigid frame 5 with a pipe like member 6 near the bottom which holds bushings or bearings for pin 2 to pass through. This allows frame 5 to rotate about pin 2. Both the right and left ends of frame 5 are configured for the attachment of the "Wings"which rotate in relation to the "Center Frame". Brackets 7 and 8 at each end of frame 5 serve as the mounting points for the "Wing". Attached to frame member 6 are brackets 11 and 12 where "Wing" rotation hydraulic cylinders 13 and 14 mount. Mounting bracket 15 is for attachment of hydraulic cylinder 4. The working surface of the "Center Frame" may be either an open or closed non-skid material (not shown in its entirety) attached to frame 5. The hydraulic controls and emergency "kill switch" may be co-located at panel 16 which is mounted on guard rail 29.

Each "Wing" consists of two frame arms 17 and 18 which are connected together at the end away from the "Center Frame" by a connector plate 19 and at the end nearest the "Center Frame" by bracket 20. Connector 19 and Bracket 20 are attached to the arms with mechanical fasteners to allow the step units 21 to be easily removed and replaced. On the center member of bracket 20 are attachment points 22 (see "Right Wing") for attaching hydraulic cylinders 13 and 14. The "Wing" arms 17 and 18 are each connected to frame 5 by bolts and appropriate bearings or bushings.

Mounted within the "Wing" frame are a number of steps 21. As shown in FIG. 4*a* each step consists of a tread surface 28, side plates 22 and 23, mounting pins 24 and 25, and turning arm pins 26 and 27. The mounting pins 24 and 25 rotate in a hole in frame arms 17 and 18 with appropriate spacers, bearings and bushings. The turning arms 9 and 10 are secured to each step by turning arm pin 26 and 27 respectively and the appropriate bearings, bushings and mechanical fasteners. The turning arms 9 and 10 are connected to the frame 5 at bracket 7 and 8. Each "Wing" may have guard rails 30 either permanently affixed or removable as applications require. Guard rails could either be attached to act as parallel arms to the "Wings" as shown in FIG. 1 or rigidly attached as shown in the other figures. In order for the turning arms 9 and 10 to remain parallel to frame members 17 and 18 during "Wing" rotation, and keep the step tread 28 in a continually horizontal position; the vertical distance from the "Wing's" center of rotation to the turning arm's center of rotation; must be equal to; the vertical distance between the step mounting pin 24/25 and turning arm pin 26/27.

The hydraulic system consists of the prime mover's hydraulic pump, filter, reservoir and control valves which are used for lift and curl. The invention's hydraulics connect to the prime mover system to provide pressure to cylinders 4, 13 and 14. Quick connectors can be used to connect the invention to the prime mover. Hydraulic hoses of various lengths are required to interconnect necessary valves and cylinders.

MODE OF OPERATION

Figure 3:
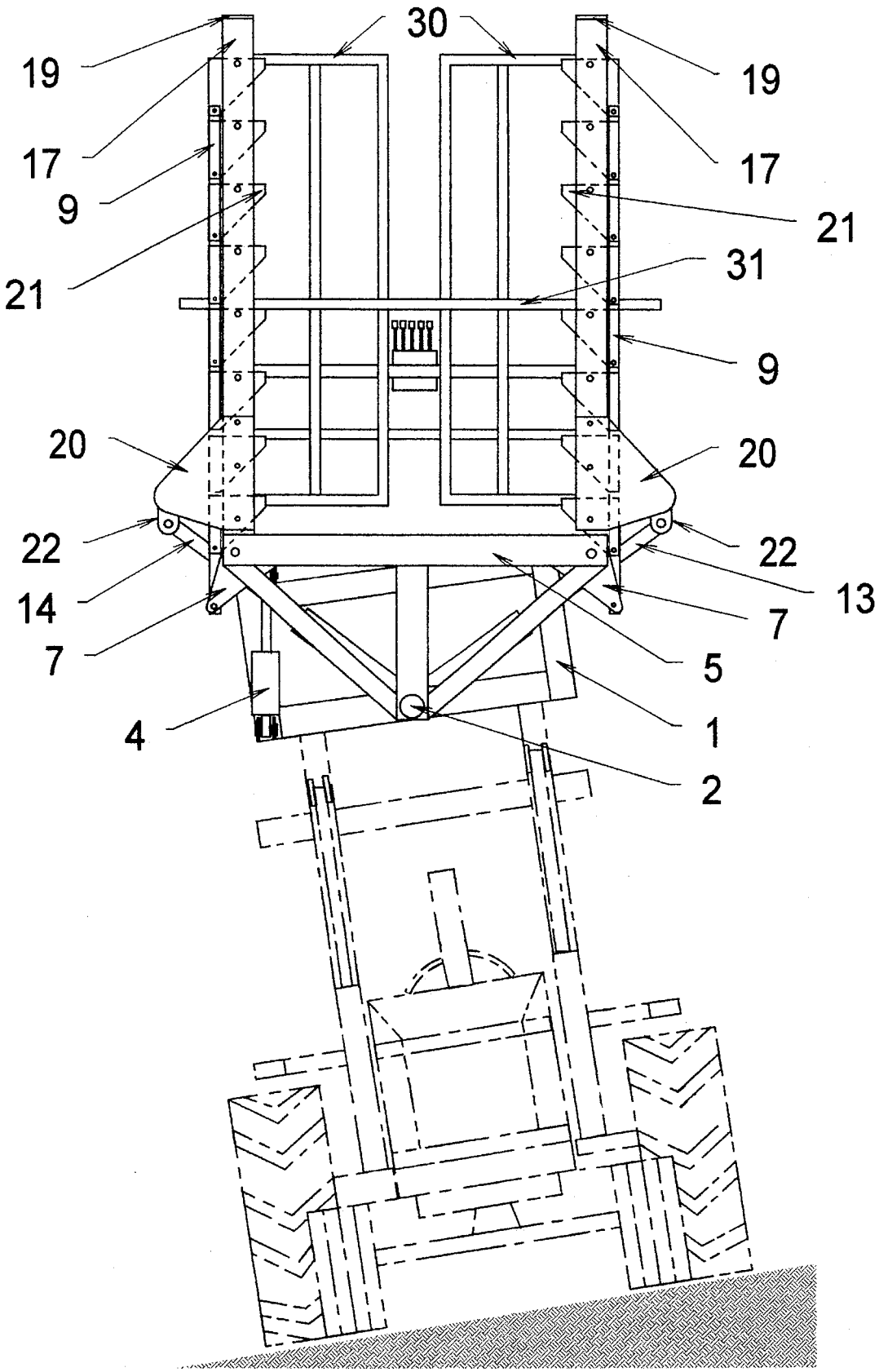
FIG. 3 is a front view with the invention mounted on an utility tractor with front end loader. The utility tractor is sitting on a side sloping surface. Hydraulic cylinder 4 has been extended to rotate the "Center Frame" about pin 2 to keep the invention level despite the side slope. Both "Wings" are in the full up position with a separate scaffolding board in place.

The invention is used in one of three basic configurations. With the "Wings" extended horizontally out from the "Center Frame" and raised into a comfortable work height the invention becomes a long work platform. With one "Wing" lowered to approximately a 45 degree angle and the other raised to approximately a 45 degree angle the invention becomes a portable stair system. With both "Wings" raised to their vertical position, as shown in FIG. 3, a separate walkway 31 can be placed across the top of a step on each "Wing" to provide a short working surface at higher elevations.

I claim:

1. A scaffolding system comprising:

a center platform including a means to attach it to a prime mover such as a front end loader or forklift;

an appendage or wing from one or more sides of the center platform and including a means of rotating the wing or appendage in relation to the center platform;

a number of individual steps mounted in the appendage or wing and including a means for retaining the steps horizontal during rotation of the appendage or wing;

a means of rotating the center platform into a horizontal plane along its long axes.

* * * * *